US005880389A

United States Patent [19]

Muramatsu

[11] Patent Number: 5,880,389

[45] Date of Patent: Mar. 9, 1999

[54] KEYBOARD MUSICAL INSTRUMENT HAVING KEY-TOUCH GENERATOR CHANGING LOAD EXERTED ON KEYS DEPENDING UPON SOUNDS TO BE PRODUCED

[75] Inventor: Shigeru Muramatsu, Shizuoka, Japan

[73] Assignee: Yamaha Corporation, Japan

[21] Appl. No.: 887,596

[22] Filed: Jul. 3, 1997

[30] Foreign Application Priority Data

Jul. 3, 1996 [JP] Japan ..... 8-173873

[51] Int. Cl.[6] ..... G10H 1/055; G10H 1/18

[52] U.S. Cl. ..... 84/615; 84/626; 84/658; 84/21; 84/DIG. 25

[58] Field of Search ..... 84/615, 626, 658, 84/687–690, 719–721, 744–746, 2, 3, 20–23, 171, 115, DIG. 7, DIG. 25

[56] References Cited

U.S. PATENT DOCUMENTS 4,528,885 7/1985 Chihana ..... 84/626
4,972,753 11/1990 Adachi et al. ..... 84/626
5,335,574 8/1994 Matsunaga et al. ..... 84/21
5,376,753 12/1994 Kosugi et al. ..... 84/658
5,391,830 2/1995 Nishino et al. ..... 84/626

*Primary Examiner*—Stanley J. Witkowski
*Attorney, Agent, or Firm*—Ostrolenk, Faber, Gerb & Soffen, LLP

[57] ABSTRACT

A keyboard musical instrument is fabricated on the basis of an upright piano, and an electronic sound generating system is incorporated therein so as to selectively generate an acoustic piano sound and an electronic sound; a plurality of leaf spring members are provided for the keys of the acoustic piano for imparting a key touch like an electronic keyboard, and a change-over mechanism selectively engages key action mechanisms with the keys and the leaf spring members with the keys so that a player can select the piano key touch or the other key touch like the electronic keyboard depending upon the sound for a performance.

10 Claims, 2 Drawing Sheets

KEYBOARD MUSICAL INSTRUMENT HAVING KEY-TOUCH GENERATOR CHANGING LOAD EXERTED ON KEYS DEPENDING UPON SOUNDS TO BE PRODUCED

FIELD OF THE INVENTION

This invention relates to a keyboard musical instrument and, more particularly, to a keyboard musical instrument having a key-touch generator for changing load exerted to keys.

DESCRIPTION OF THE RELATED ART

Manufacturers presently offer various kinds of keyboard musical instruments such as an acoustic piano, an electronic keyboard, a silent piano and so on, and musicians enjoys these keyboard musical instruments.

The electronic keyboard has a plurality of turnable keys urged to respective rest positions by means of spring members, and sensors monitor the keys to see whether or not a player depresses them. When a musician depresses a key, the key is moved from the rest position toward the end position against the resilient force of the spring member, and the associated key sensor produces a key position signal representative of the downward motion of the key. The key position signal is supplied to a digital signal processor, and a music data code is formed on the basis of the key position signal. The music data code is supplied from the digital signal processor to a tone generator, and the tone generator tailors an audio signal. The audio signal is supplied to a speaker system, and the speaker system produces an electronic sound from the audio signal. The resilient force is simply exerted on the key moved between the rest position and the end position, and the player feels the load constant.

The acoustic piano also has a keyboard consisting of black keys and white keys, and the black/white keys are linked with key action mechanisms for driving hammers. When a players depresses a black/white key, the depressed key actuates the associated key action mechanism on the way from the rest position toward the end position. The key action mechanism rotates the hammer toward a set of strings, and the hammer suddenly escapes from the key action mechanism on the way toward the set of strings. For this reason, the player firstly feels the key heavy, and then feels the key suddenly become light.

The silent piano is a combination of the acoustic piano and the electronic keyboard, and is fabricated on the basis of the acoustic piano. A hammer stopper is provided between the hammers and the sets of strings, and key sensors, a digital signal processor and a tone generator are installed in the acoustic piano. The hammer stopper is changed between a free position and a blocking position. While the hammer stopper is staying in the free position, the hammer can strike the sets of strings, and the silent piano behaves as similar to the acoustic piano. However, when the hammer stopper is changed to the blocking position, the hammers rebound on the hammer stopper after the escape, and do not strike the sets of strings. The key sensors monitor the black/white keys, and supply the key position signal to the digital signal processor. A music data code is formed on the basis of the key position signal, and the tone generator tailors an analog signal so as to produce an electronic sound. The player feels the key touch identical with that of the acoustic piano.

If a musician has played the acoustic piano, he does not feel the key touch of the silent piano strange. However, if he has played the electronic keyboard, he feels the key touch of the silent piano strange, and yearns to play the silent piano in key touch like the electronic keyboard.

SUMMARY OF THE INVENTION

It is therefore an important object of the present invention to provide a keyboard musical instrument in which a key touch is changeable.

In accordance with the present invention, there is provided a keyboard musical instrument comprising: a keyboard having a plurality of keys tunable between rest positions and end positions; a sound generating system responsive to a motion of each of the plurality of keys so as to generate a sound; a key touch generator connected to the plurality of keys, and providing a first resistance to the motion of each of the plurality of keys; a second key touch generator connected to the plurality of keys, and providing a second resistance different from the first resistance to the motion of each of the plurality of keys; and a change-over unit connected to the first key touch generator and the second key touch generator, and selectively enabling the first key touch generator and the second key touch generator.

BRIEF DESCRIPTION OF THE DRAWINGS

The features and advantages of the keyboard musical instrument according to the present invention will be more clearly understood from the following description taken in conjunction with the accompanying drawings in which.

DESCRIPTION OF THE PREFERRED EMBODIMENTS

First Embodiment

Figure 1:
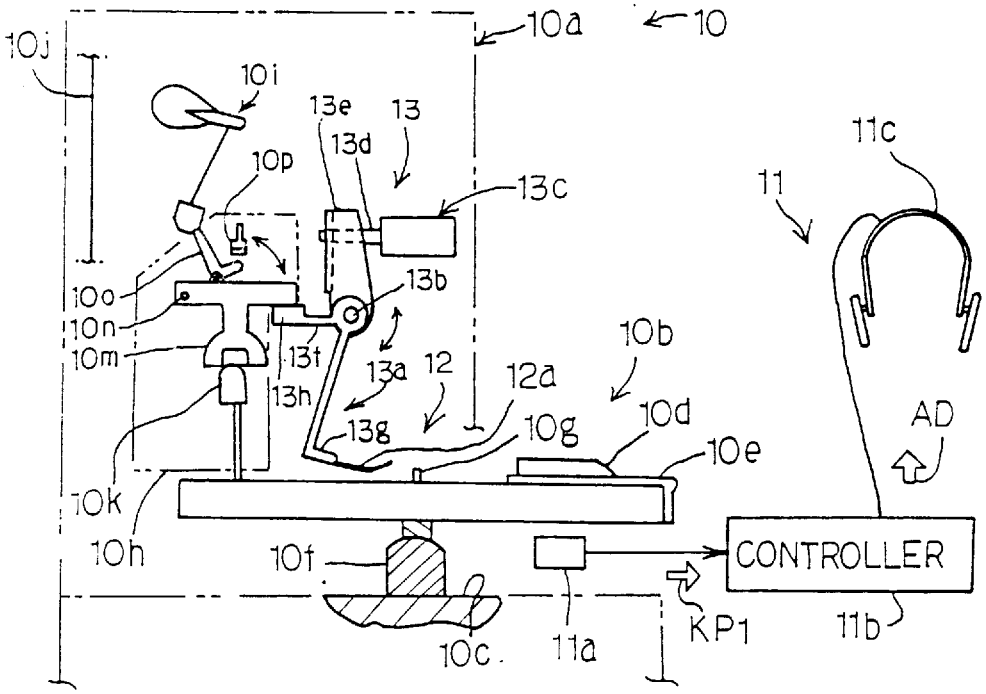
FIG. 1 is a schematic view showing a keyboard musical instrument according to the present invention.

Referring first to FIG. 1 of the drawings, a keyboard musical instrument embodying the present invention largely comprises an upright piano 10, an electronic sound generating system 11, a load applying system 12 and a change-over mechanism 13. In the following description, the term "front" indicates a position closer to a player sitting in front of the upright piano and the term "rear" indicates a position further from the player; a lateral direction is a direction perpendicular to an axis between the front and the rear.

The upright piano 10 is a standard upright piano, and includes a piano case 10*a* and a keyboard 10*b* mounted on a key bed 10*c* forming a part of the piano case 10*a*. A plurality of black keys 10*d* and a plurality of white keys 10*e* are arranged in the lateral direction, and form in combination the keyboard 10*b*. A balance rail 10*f* extends on the key bed 10*c* in the lateral direction, and balance pins 10*g* project from the balance rail 10*f* at intervals. The black/white keys 10*d*/10*e* are turnable around the balance pins 10*g*, and are maintained at rest positions without any force exerted thereon. A player depresses the front end portions of the black/white keys 10*d*/10*e*, and the depressed black/white keys 10*d*/10*e* is moved from the rest position to an end position where the lower end surface of the depressed key is brought into contact with a front pin cloth on a front rail (not shown).

The upright piano 10 further includes a plurality of key action mechanisms 10*h* respectively linked with the black/white keys 10*d*/10*e*, a plurality of hammers 10*i* respectively driven for rotation by the key action mechanisms 10*h*, a plurality of sets of strings 10*j* respectively struck by the hammers 10*i* and a plurality of damper mechanisms (not shown) for damping the strings 10*j*. These mechanisms are well known to a skilled person, and description is hereinbelow made on parts for imparting the piano key touch only.

A capstan button 10*k* projects from each of the black/white keys 10*d*/10*e*, and is held in contact with a whipped assembly 10*m*. The whipped assembly 10*m* is turnable around a pin 10*n*, and a jack 10*o* is turnably supported by the whipped assembly 10*m*. A regulating button 10*p* is opposed to a toe of the jack 10*o*, and the hammer 10*i* is engaged with the jack 10*o*. While the associated black/white key 10*d*/10*e* is being moved from the rest position to an intermediate position, the capstan button 10*k* causes the whipped assembly 10*m* to turn in the counter clockwise direction, and the toe of the jack 10*o* is getting closer and closer to the regulating button 10*p*. The hammer 10*i* is rotated toward the set of strings 10*j* at low speed. When the toe of the jack 10*o* is brought into contact with the regulating button 10*p*, the jack 10*o* quickly turns on the whipped assembly 10*m*, and the hammer 10*i* escapes from the jack 10*o* so as to start a free rotation. The hammer 10*i* strikes the set of strings 10*j*, and rebound thereon.

While the black/white key 10*d*/10*e* is traveling from the rest position to the intermediate position where the hammer 10*i* escapes from the jack 10*o*, the key action mechanism 10*h* and the hammer 10*i* build up resistance to the black/white key 10*d*/10*e*, and the player feels the key heavy. However, after the escape of the hammer 10*i*, the load is decreased, and the player feels the black/white key 10*d*/10*e* lighter. Thus, the key action mechanisms 10*h* and the hammers 10*i* generate the piano key touch, and as a whole constitute a first key touch generator.

The electronic sound generating system 11 includes a plurality of key sensors 11*a* respectively monitoring the black/white keys 10*d*/10*e* for producing key position signals KP1, a controller 11*b* for processing pieces of positional information represented by the key position signals KP1 for producing an audio signal AD and a head-phone 11*c* for producing an electronic sound from the audio signal AD. The controller 11*b* has a digital signal processor and a tone generator, and produces the audio signal as similar to the prior art electronic keyboard. The controller 11*b* allows a user to select one of timbres, and imparts the selected timbre to the electronic sounds.

The load applying system 12 is implemented by a plurality of leaf spring members 12*a*. The leaf spring members 12*a* are attached to the change-over mechanism 13. When a player wants a key touch like an electronic keyboard, the leaf spring members 12*a* are pressed against the rear upper surfaces of the black/white keys 10*d*/10*e*, respectively, and urge the black/white keys 10*d*/10*e* to return to the respective rest positions. For this reason, when a player depresses a black/white key 10*d*/10*e*, the black/white key 10*d*/10*e* needs to deform the leaf spring member 12*a*, and the resistance is substantially constant during the key motion. Thus, the leaf spring members 12*a* provides the resistance different from that of the key action mechanisms 10*h* and the hammers 10*i*, and serve as a second key touch generator.

The change-over mechanism 13 includes an L-letter shaped lifting lever 13*a* turnable around a shaft member 13*b*, a solenoid-operated actuator unit 13*c* having a plunger 13*d* projectable from and retractable into a space defined by a solenoid coil (not shown) and a connecting rod 13*e* provided between the plunger 13*d* and the L-letter shaped lifting lever 13*a*. The L-shaped lifting lever 13*a* has a short arm 13*f* and a long arm 13*g*, and a cushion member 13*h* and the leaf spring member 12*a* are attached to the short arm 13*f* and the long arm 13*g*, respectively. Though not shown in the drawings, a coil spring urges the plunger 13*d* in a direction projecting from the solenoid coil. When the solenoid-coil is energized, the electro-magnetic force retracts the plunger 13*d* into the space.

The change-over mechanism 13 is changed between a first position and a second position. The change-over mechanism 13 is shown in FIG. 6 staying in the first position where the capstan button 10*k* is held in contact with the whipped assembly 10*m* and the leaf spring members 12*a* are spaced from the rear upper surfaces of the black/white keys 10*d*/10*e*. For this reason, the load applying system 12 is disabled, and no resilient force is applied to the black/white keys 10*d*/10*e*. In this situation, when a player depresses a black/white key 10*d*/10*e*, the key action mechanism 10*h* and the hammer 10*i* causes the player to feel the piano key touch.

When the solenoid coil is energized, the plunger 13*d* is retracted, and the L-letter shaped lifting lever 13*a* turns in the clockwise direction. The short arm 13*f* causes the whipped assembly 10*m* to turn in the counter clockwise direction, and the whipped assembly 10*m* is spaced from the capstan button 10*k*. As a result, the key action mechanism 10*h* stands idle during the motion of the black/white key 10*d*/10*e*. On the other hand, the long arm 13*g* presses the leaf-spring members 12*a* against the rear upper surfaces of the black/white keys 10*d*/10*e*. In this situation, when a player depresses a black/white key 10*d*/10*e*, the black/white key 10*d*/10*e* is moved against the resilient force of the leaf spring member 12*a*, and the player feels the key touch like the electronic keyboard. The hammer does not strike the set of strings 10*j*, and no acoustic sound is generated. However, the controller 11*b* is powered together with the solenoid-operated actuator unit 13*c*, and cooperates with the key sensors 11*a* so as to generate the electronic sounds. The resistance due to the leaf spring members 12*a* is lighter than that of the key action mechanisms/hammers 10*h*/10*i*, and the player can easily perform a fast passage.

Assuming now that a player requests the keyboard musical instrument to generate the acoustic sounds, the solenoid-operated actuator unit 13*c* is deenergized, and the plunger 13*d* projects so as to change the L-letter shaped lifting lever 13*a* from the second position to the first position. The leaf spring members 12*a* are spaced from the rear upper surfaces of the black/white keys 10*d*/10*e*, and the whipped assemblies 10*m* are brought into contact with the capstan buttons 10*k*, respectively. The electric power is not supplied to the controller 11*b*.

The player selectively depresses the black/white keys 10*d*/10*e*, and the depressed black/white keys 10*d*/10*e* actuate the associated key action mechanisms 10*h* so as to strike the sets of strings 10*j* with the hammers 10*i*. The strings 10*j* vibrate, and produce the acoustic sounds. The key action mechanisms 10*h* changes the load exerted on the depressed black/white keys 10*d*/10*e* at the escape form the jacks 10*o*, and the player feels the key touch like a standard upright piano.

On the other hand, when the player energizes the solenoid-operated actuator unit 13*c* and the controller 11*b*, the change-over mechanism 13 is changed from the first position to the second position. The whipped assemblies 10*h* are spaced from the capstan buttons 10*k*, and the leaf spring members 12*a* are pressed against the rear upper surfaces of the black/white keys 10*d*/10*e*. While the player is fingering on the keyboard 10*b*, the depressed black/white keys 10*d*/10*e* are moved against the resilient forces of the leaf spring members 12*a*, and the player feels the key touch like the electronic keyboard. The key sensors 11*a* report the key motions to the controller 11*b*, and the controller 11*b* produces the audio signal AD. The audio signal AD is supplied to the head-phone 11*c*, and produces the electronic sounds corresponding to the depressed keys.

As will be appreciated from the foregoing description, the change-over mechanism 13 selectively enables the load applying system 12 and the key action mechanisms/hammers 10*h*/10*i*, and the player changes the key touch between the upright piano and the electronic keyboard.

Second Embodiment

Figure 2:
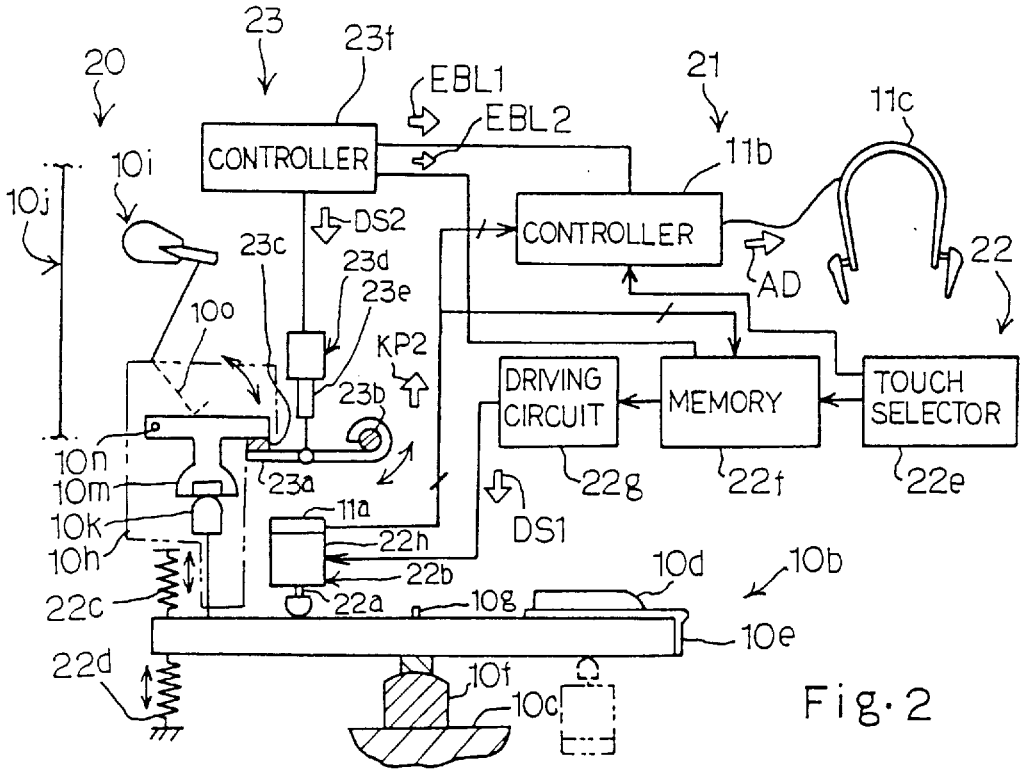
FIG. 2 is a schematic view showing another keyboard musical instrument according to the present invention.

Turning to FIG. 2 of the drawings, another keyboard musical instrument embodying the present invention also largely comprises an upright piano 20, an electronic sound generating system 21, a load applying system 22 and a change-over system 23. The upright piano 20 is similar to the upright piano 10, and the corresponding parts of the upright piano 20 are labeled with the same referenced legends without detailed description.

The electronic sound generating system 21 is also similar to the electronic sound generating system 11. For this reason, corresponding components of the electronic sound generating system are labeled with the same referenced legends.

The load applying system 22 includes first spring members 22*c* urging the black/white keys 10*d*/10*e* toward the rest positions and second spring members 22*d* urging the black/white keys 10*d*/10*e* toward the end positions, and the resilient force of each first spring member 22*c* is balanced with the resilient force of the associated second spring member 22*d* at the rest position of the associated black/white key 10*d*/10*e*.

The load applying system 22 further includes the solenoid-operated actuators 22*b*, the position sensors 11*a*, a touch selector for selecting one of timbres, a memory 22*f* for storing a plurality of key touch tables and a driving circuit for controlling the solenoid-operated actuators 22*b*. In this instance, the position sensors 11*a* are implemented by photo-interrupters.

Though not shown in the drawings, coil springs retract the plungers 22*a* into the yoke 22*h*, and the plungers 22*a* are held in contact with the rear upper surfaces of the black/white keys 10*d*/10*e*, respectively. When the solenoid coils are energized, the plungers 22*a* project from the yoke 22*h* against the resilient forces of the coil springs, and pushes down the rear upper surfaces of the black/white keys 10*d*/10*e*. The projecting length of the plunger 22*a* is changeable by controlling the amount of electric power supplied to the solenoid coil.

The plurality of key touch tables correspond to the timbres selectable by the player, and a variation of load exerted on the black/white key 10*d*/10*e* is memorized in each of the key touch tables. If the selected timbre is a piano sound, the load is suddenly changed at the escape point, and the key touch table corresponding to the piano sound stores the variation of the load suddenly changed at the escaping point. The load data representative of the variation is sequentially read out from the selected key touch table depending upon the current key position represented by a key position signal KP2, and the driving circuit 22*g* changes the magnitude of a driving current signal DS1. As a result, the solenoid-operated actuator 22 varies the load with the magnitude of the driving current signal DS2, and the player feels the variation of load as a key touch.

The change-over system 23 includes a lifting lever 23*a* turnable around a shaft member 23*b*, a cushion member 23*c* attached to the leading end portion of the lifting lever 23*a*, a solenoid-operated actuator unit 23*d* having a plunger 23*e* connected to the lifting lever 23*a* and a controller 23*f* for supplying a driving current signal DS2 and enable signals EBL1/EBL2. The cushion member 23*a* is held in contact with the whipped assemblies 10*m*. A coil spring urges the plunger 23*e* of the solenoid-operated actuator unit 23*d* to project from the case, and the lifting lever 23*a* and the cushion member 23*c* allows the whipped assemblies 10*m* to be held in contact with the capstan buttons 10*k*. However, when the controller 23*f* energizes the solenoid-operated actuator unit 23*d* with the driving current signal DS2, the plunger 23*e* is retracted so as to space the whipped assemblies 10*m* from the capstan buttons 10*k*. In this situation, a depressed black/white key 10*d*/10*e* does not actuate the associated key action mechanism 10*h*, and the hammer 10*i* is continuously engaged with the jack 10*o*.

The controller 23*f* further supplies the enable signals EBL1/EBL2 to the controller 11*b* and the memory 22*f*. The controller 11*b* becomes responsive to the key position signals KP2 so as to generate the audio signal AD, and the load data are sequentially read out from the selected key touch table in response to the key position signals KP2.

Assuming now that a player requests the keyboard musical instrument to generate the acoustic sounds, the solenoid-operated actuator unit 23*d* is deenergized, and the plunger 23*e* projects so as to engage the whipped assemblies 10*m* with the capstan buttons 10*k*. The enable signals EBL1/EBL2 are not supplied to the controller 11*b* and the memory 22*f*, and they are disabled.

The player selectively depresses the black/white keys 10*d*/10*e*, and the depressed black/white keys 10*d*/10*e* actuate the associated key action mechanisms 10*h* so as to strike the sets of strings 10*j* with the hammers 10*i*. The strings 10*j* vibrate, and produce the acoustic sounds. The key action mechanisms 10*h* changes the load exerted on the depressed black/white keys 10*d*/10*e* at the escape form the jacks 10*o*, and the player feels the key touch like a standard upright piano. The plungers 22*a* are retracted into the cases, and no load is applied to the black/white keys 10*d*/10*e*.

On the other hand, when the player requests the keyboard musical instrument to generate the electronic sounds, the controller 23*f* supplies the driving current signal DS2 to the solenoid-operated actuator unit 23*d*, and the solenoid-operated actuator unit 23*d* retracts the plunger 23*e* into the case. As a result, the lifting lever 23*a* causes the whipped assemblies 10*m* to turn in the counter clockwise direction, and the whipped assemblies 10*m* are spaced from the capstan buttons 10*k*.

The controller 23*f* supplies the enable signals EBL1/EBL2 to the controller 11*b* and the memory 22*f*, and the electronic sound generating system 21 and the load applying system 22 are activated. The player may select a timbre through the manipulation of the touch selector 22*e*.

The white key 10*e* is assumed to be depressed during the performance. The white key 10*e* is traveling from the rest position toward the end position. The position sensor 11*a* is detecting the current key position, and supplies the key position signal KP2 representative of the current key position. The controller 11*b* produces a music data code on the basis of the key position signal KP2, and tailors the audio signal AD from the music data code. An appropriate envelope is applied for the selected timbre, and an electronic sound is generated through the head-phone 11*c*.

While the position sensor 11*a* is varying the value of the key position signal KP2, the load data are sequentially read out from the key touch table corresponding to the selected timbre, and are supplied to the driving circuit 22*g*. The driving circuit 22*g* is responsive to the load data, and changes the magnitude of the driving current signal DS1 with the load data. The solenoid operated actuator unit 22*b* changes the electromagnetic force in proportional to the magnitude of the driving current signal DS1 or the load data, and the player feels the load exerted on the white key 10*e* as a key touch like the keyboard musical instrument for which the timbre is selected.

If the player wants to finger on the keyboard 10*b* in an extremely light key touch, the controller 23*f* supplies the driving current signal DS2 and the enable signal EBL2 to the solenoid-operated actuator unit 23*d* and the controller 11*b* only. In this situation, only the electronic sound generating system 21 is enabled, and the first and second springs 22*c*/22*d* generate the extremely light key touch.

As will be understood from the foregoing description, the change-over system 23 changes the key touch between the upright piano and other keyboard musical instrument such as an electronic keyboard, harpsichord and a celesta.

Third Embodiment

Figure 3:
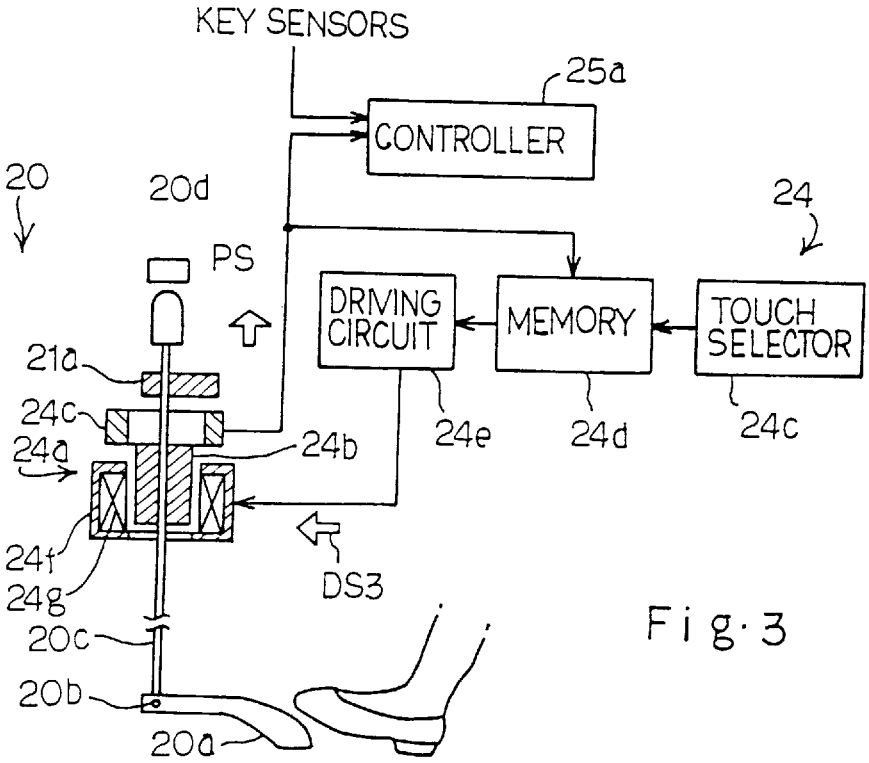
FIG. 3 is a partially cut-away side view showing a pedal mechanism incorporated in yet another keyboard musical instrument according to the present invention.
Figure 4:
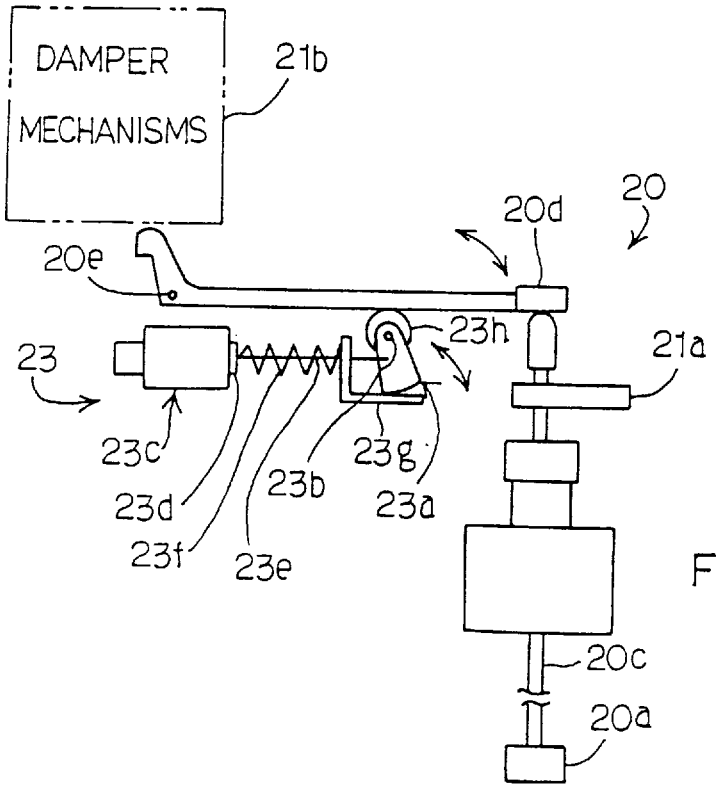
FIG. 4 is a front view showing the pedal mechanism.

Turning to FIGS. 3 and 4 of the drawings, a pedal mechanism 20 is incorporated in yet another keyboard musical instrument embodying the present invention. Although the keyboard musical instrument further includes a keyboard, an electronic sound generating system, a load applying system and a change-over mechanism, these are similar to those of the first embodiment or the second embodiment, and are not detailed hereinbelow.

The pedal mechanism 20 includes a pedal 20*a* turnable around a shaft member 20*b* and a pedal shaft 20*c* connected to the pedal 20*a*, and the pedal shaft 20*c* is slidably supported by a frame 21*a* of the upright piano so that the pedal 20*a* moves the pedal shaft 20*c* in an up-and-down direction.

The pedal mechanism 20 further includes a pedal arm 20*d* turnable around a shaft member 20*e*, and is shaped into an L-letter configuration. The pedal shaft 20*c* is held in contact with one end portion of the pedal arm 20*d*, and causes the pedal arm 20*d* to turn around the shaft member 20*e*. Damper mechanisms 21*b* are engaged with the pedal arm 20*d*, and are spaced from the sets of strings by the pedal arm 20*d*. When a player depresses the pedal 20*a*, the damper shaft 20*c* is upwardly lifted, and the damper arm 20*d* turns around the shaft member 20*e* so as to space the dampers of the damper mechanisms 21*b* from the sets of strings. Thus, the player feels the load due to the damper mechanisms 21*b*. When the keyboard musical instrument implementing the third embodiment serves as an acoustic upright piano, the pedal mechanism 20 behaves as similar to the damper pedal mechanism of a standard upright piano. However, when the keyboard musical instrument serves as an electronic keyboard, another change-over mechanism 23 disables the damper mechanisms 21*b*, and another load applying mechanism 24 exerts load on the pedal 20*a*.

The change-over mechanism 23 includes a toggle 23*a* turnable around a shaft member 23*b*, a solenoid-operated actuator unit 23*c* having a plunger 23*d*, a connecting rod 23*e* connected between the plunger 23*d* and the toggle 23*a* and a spring member 23*f* urging the plunger 23*d* into the case of the actuator unit 23*c*. The solenoid-operated actuator unit 23*c* is stationary with respect to a piano case, and the shaft member 23*b* is stationary with respect to an angle member 23*g* attached to the piano case. A roller 23*h* of the toggle 23*a* is held in contact with the pedal arm 20*d*.

While no current is supplied to the solenoid-operated actuator unit 23*c*, the spring member 23*f* retracts the plunger 23*e* into the case, and the connecting rod 23*e* causes the toggle 23*a* to decline from the vertical position. As a result, the toggle 23*a* allows the pedal arm 20*d* to be held in contact with the pedal shaft 20*c*, and the pedal arm 20*d* transfers the motion of the pedal shaft 20*c* to the damper mechanisms 21*b*. On the other hand, when the solenoid-operated actuator unit 23*c* is energized, the plunger 23*d* projects from the case, and changes the toggle 23*a* to the vertical position. The roller 23*h* lifts the pedal arm 20*d*, and spaces the pedal arm 20*d* from the pedal shaft 20*c*. For this reason, Even if a player depresses the pedal 20*a*, the pedal shaft 20*c* does not push the pedal arm 20*d*. Thus, the change-over mechanism 23 changes the damper mechanisms 21*b* between the disable state and the enable state.

The load applying system 24 includes a solenoid-operated actuator unit 24*a* having a plunger 24*b* fixed to the pedal shaft 20*c*, a pedal sensor 24*c* monitoring the pedal shaft 20*c* and, accordingly, the pedal 20*a*, a touch selector 24*c*, a memory 24*d* and a driving circuit 24*e*. The pedal sensor 24*c* produces a pedal position signal PS indicative of current pedal position, and supplies the pedal position signal PS to both of the controller 25*a* of the electronic sound generating system and the memory 24*d*. The controller 25*a* is responsive to the pedal position signal PS, and prolongs the electronic sound as similar to the lifted dampers prolong the acoustic piano sounds. In this instance, the pedal sensor 24*c* is implemented by photo-interrupters.

The yoke unit 24*f* of the solenoid-operated actuator unit 24*a* is fixed to the piano case, and s solenoid-coil 24*g* is accommodated in the yoke unit 24*f*. The plunger 24*b* is movable together with the pedal shaft 20*c*. When the solenoid coil 24*g* is energized, the solenoid coil 24*g* generates electromagnetic force, and downwardly urges the plunger 24*b* and, accordingly, the pedal shaft 20*c*. A player feels the electromagnetic force as a load exerted on the pedal 20*a*. The load is variable with the current pedal position as described hereinbefore.

A plurality of pedal touch tables are stored in the memory 24*d*, and each of the pedal touch tables contains a series of load data variable with the current pedal position. The sets of load data are representative of variations of the load exerted on the pedal 20*a* of different keyboard musical instruments. A player selects one of the pedal touch tables by manipulating the touch selector 24*c*.

When a player selects one of the pedal touch tables, the load data are sequentially read out from the selected pedal touch table to the driving circuit 24*e* in dependence on the current pedal position, and the driving circuit 24*e* generates a driving current signal DS3 on the basis of the load data. The magnitude of the driving current signal DS3 varies together with the magnitude of the load, and the driving signal DS3 is supplied to the solenoid-operated actuator unit 24*a*. The solenoid-operated actuator unit 24*a* generates the electromagnetic force from the driving current signal DS3, and the player feels the load on the pedal 20*a* as if the damper mechanisms 21*b* exerts the weight on the pedal 20*a*.

Assuming now that a player requests the keyboard musical instrument to serve as the upright piano, the change-over mechanism 23 allows the pedal arm 20*d* to be held in contact with the pedal shaft 20*c*, and the player lifts the dampers of the damper mechanisms 21*b* by depressing the pedal 20*a*. The player feels the standard pedal touch of the damper pedal.

On the other hand, when the player requests the keyboard musical instrument to serve as an electronic keyboard, the solenoid-operated actuator unit 23*c* is energized, and the plunger 23*d* projects from the case. The toggle 23*a* is changed to the vertical position, and spaces the pedal arm 20*d* from the pedal shaft 20*c*. The touch selector 24*c* specifies the pedal touch table representative of the variation of load for the electronic keyboard.

While the player is playing a tune on the keyboard, the electronic sound generating system produces the electronic sounds instead of the piano sounds, and the load applying system exerts load to the black/white keys as described in conjunction with the first and second embodiments.

The player is assumed to depress the pedal 20*a* during the performance, and the pedal 20*a* upwardly lifts the pedal shaft 20*c*. The motion of the pedal shaft 20*c* is detected by the pedal sensor 24*c*, and the current pedal position is transferred to the controller 25*a* and the memory 24*d* by the pedal position signal PS. The controller 25*a* imparts the effect similar to the damper pedal to the electronic sounds.

The load data are sequentially read out from the selected table to the driving circuit 24*e*, and the driving circuit 24*e* changes the magnitude of the driving current signal DS3 depending upon the load data. The solenoid-operated actuator unit 24*a* exerts the load on the pedal 20*a* through the pedal shaft 20*c*, and the load varies like the load on the pedal of the electronic keyboard. For this reason, the player feels the pedal touch like the pedal of the electronic keyboard.

The keyboard musical instrument implementing the third embodiment achieves all the advantages of the second embodiment and an additional advantage in the pedal touch like that of selected keyboard musical instrument.

In this instance, the damper mechanisms serves as a first pedal touch generator, and the solenoid-operated actuator unit 24*a*, the pedal sensor 24*c*, the memory 24*d* and the driving circuit 24*e* as a whole constitute a second pedal touch generator.

As will be appreciated from the foregoing description, the load applying system and the change-over system give different touch to the player, and a player uses the keyboard musical instrument according to the present invention as different kinds of keyboard musical instruments.

Although particular embodiments of the present invention have been shown and described, it will be obvious to those skilled in the art that various changes and modifications may be made without departing from the spirit and scope of the present invention.

For example, the solenoid-operated actuators 22*b* may be placed under the front portions of the black/white keys 10*d*/10*e* as indicated by dots-and-dash line in FIG. 2. In this instance, the position sensors 11*a* may monitors the plungers of the solenoid-operated actuators 22*b*.

A keyboard musical instrument may have the change-over mechanism 23 and the load applying system 24 only.

Moreover, a key/pedal sensor may detect a key/pedal velocity, a key/pedal acceleration or a force exerted on the key/pedal.

What is claimed is:

1. A keyboard musical instrument comprising:

a keyboard having a plurality of keys movable between rest positions and end positions when fingers of a player selectively depress said plurality of keys;

a sound generating system responsive to a motion of each of said plurality of keys so as to generate a sound;

a first key touch generator connectable to said plurality of keys, and providing a first resistance against said fingers through keys depressed by said player;

a second key touch generator connectable to said plurality of keys, and providing a second resistance different from said first resistance against said fingers through the keys selectively depressed by said player; and a change-over unit connected to said first key touch generator and said second key touch generator, and responsive to an instruction of said player for selectively connecting said first key touch generator and said second key touch generator to said plurality of keys.

2. The keyboard musical instrument as set forth in claim 1, in which said sound generating system includes a plurality of strings vibrating for producing a first kind of said sound and an electronic sound generating system for generating a second kind of said sound, and said first key touch generator includes a plurality of key action mechanisms linked with said plurality of keys and a plurality of hammers escaping from said plurality of key action mechanisms on the way from said rest positions and said end positions for striking said plurality of strings.

3. The keyboard musical instrument as set forth in claim 2, in which each of said plurality of key action mechanisms has a capstan button projecting from one of said plurality of keys and a whipped assembly held in contact with said capstan button so that said whipped assembly turns during a motion of said one of said plurality of keys, and said change-over unit causes said whipped assembly to forcibly turn so as to space said whipped assembly from said capstan button when said change-over unit actuates said second key touch generator.

4. The keyboard musical instrument as set forth in claim 1, in which said sound generating system includes a plurality of strings vibrating for producing a first kind of said sound and an electronic sound generating system for generating a second kind of said sound, said first key touch generator includes a plurality of key action mechanisms linked with said plurality of keys and a plurality of hammers escaping from said plurality of key action mechanisms on the way from said rest positions and said end positions for striking said plurality of strings, and said second key touch generator includes a plurality of spring members attached to said change-over unit and urging said plurality of keys toward said rest positions, respectively.

5. The keyboard musical instrument as set forth in claim 4, in which each of said plurality of key action mechanisms has a capstan button projecting from one of said plurality of keys and a whipped assembly held in contact with said capstan button so that said whipped assembly turns during a motion of said one of said plurality of keys, and said change-over unit causes said whipped assembly to forcibly turn so as to space said whipped assembly from said capstan button and said plurality of spring members to urge said plurality of keys when said second key touch generator is selected to be actuated, said change-over unit causing said whipped assembly to be in contact with said capstan button and spacing said plurality of spring members from said plurality of keys when said first key touch generator is selected to be actuated.

6. The keyboard musical instrument as set forth in claim 1, in which said sound generating system includes a plurality of strings vibrating for producing a first kind of said sound and an electronic sound generating system for generating a second kind of said sound, said first key touch generator includes a plurality of key action mechanisms linked with said plurality of keys and a plurality of hammers escaping from said plurality of key action mechanisms on the way from said rest positions and said end positions for striking said plurality of strings, and said second key touch generator includes a memory having at least one key touch table for storing a series of load data representative of a load to be exerted on said plurality of keys for producing said second resistance, a driving circuit responsive to said series of load data read out from said at least one key touch table depending upon a current key position of one of said plurality of keys moved from said rest position to said end position and producing a driving current signal changed with said current key position, and a solenoid-operated actuator having a solenoid supplied with said driving current signal and a plunger movable with respect to said solenoid so as to impede the motion of said one of said plurality of keys.

7. The keyboard musical instrument as set forth in claim 6, in which each of said plurality of key action mechanisms has a capstan button projecting from one of said plurality of keys and a whipped assembly held in contact with said capstan button so that said whipped assembly turns during a motion of said one of said plurality of keys, and said change-over unit causes said whipped assembly to forcibly turn so as to space said whipped assembly from said capstan button and said memory and said driving circuit to respond to said current key position when said second key touch generator is selected to be actuated, said change-over unit causing said whipped assembly to be in contact with said capstan button and disabling said memory and said driving circuit when said first key touch generator is selected to be actuated.

8. The keyboard musical instrument as set forth in claim 6, in which said at least one key touch table is divided into a plurality of key touch sub-tables different in said series of load data from one another, and a player selects one of said plurality of key touch sub-tables.

9. The keyboard musical instrument as set forth in claim 1, further comprising at least one pedal for giving a musical effect to said sound, said sound generating system responsive to said at least one pedal for giving said musical effect to said sound;

a first pedal touch generator connected to said at least one pedal, and responsive to a motion of said at least one pedal for providing a third resistance to a motion of said at least one pedal;

a second pedal touch generator connected to said at least one pedal, and responsive to said motion of said at least one pedal for providing a fourth resistance different from said third resistance to said motion of said at least one pedal; and another change-over unit connected to said first pedal touch generator and said second pedal touch generator, and selectively enabling said first pedal touch generator and said second pedal touch generator.

10. A keyboard musical instrument comprising:

a keyboard for specifying a note of a scale;

a sound generating system responsive to a motion of said keyboard for generating a sound;

at least one pedal for giving a musical effect to said sound;

a first pedal touch generator connectable to said at least one pedal, and responsive to a motion of said at least one pedal for providing a first resistance against said foot through said at least one pedal;

a second pedal touch generator connectable to said at least one pedal, and responsive to said motion of said at least one pedal for providing a second resistance different from said first resistance against said foot through said at least one pedal; and a change-over unit connected to said first pedal touch generator and said second pedal touch generator, and responsive to an instruction of said player for selectively connecting said first pedal touch generator and said second pedal touch generator to said at least one pedal.

* * * * *